United States Patent [19]

Richardson et al.

[11] 4,330,155

[45] May 18, 1982

[54] BORE HOLE MINING

[75] Inventors: Paul Richardson, Santa Ana; David A. Whitley, Brea, both of Calif.

[73] Assignee: Santa Fe International Corporation, Orange, Calif.

[21] Appl. No.: 134,296

[22] Filed: Mar. 26, 1980

[51] Int. Cl.[3] ..... E21D 1/06

[52] U.S. Cl. ..... 299/11; 299/18; 299/56; 299/80; 175/96; 175/107

[58] Field of Search ..... 175/95, 96, 107; 299/18, 11, 56, 71, 80

[56] References Cited

U.S. PATENT DOCUMENTS

| | | | |
|---|---|---|---|
| 2,990,166 | 6/1961 | Walsh | 299/11 |
| 4,072,015 | 2/1978 | Morrell et al. | 299/11 |
| 4,102,415 | 7/1978 | Cunningham | 175/96 |
| 4,133,397 | 1/1979 | Tschirky | 175/107 |
| 4,160,566 | 7/1979 | McGee | 299/18 |
| 4,185,703 | 1/1980 | Gueber | 175/107 |

*Primary Examiner*—William F. Pate, III

*Attorney, Agent, or Firm*—LeBlanc, Nolan, Shur & Nies

[57] ABSTRACT

Minerals, in particular coal, that have been deposited in layers or along seams in the earth can be mined utilizing a large diameter bore hole drilling equipment. With the drilling equipment stationed on the surface of the earth, a drilling member is drilled down into the earth along the seam of the mineral deposit. If the mineral deposit extends at an angle to the earth, i.e. less than 90°, the drilling operation is conducted so as to drill at a similar angle to the earth. As the mineral deposits are broken up during the drilling operation, the broken fragments are removed from the drilled hole. After drilling has occurred for a certain distance in a forward direction, a creeping effect is induced in portions of the side walls of the drilled hole. The drilling member is then retracted from the drilled hole in such a manner so as to drill out any mineral fragments in the hole of the drilling member. These mineral fragments are then removed from the hole as the drilling member is retracted. The removal of the mineral fragments can best be accomplished utilizing an hydraulic flow mechanism for circulating fluid through the drilling member and removing the mineral fragments as they are drilled.

39 Claims, 5 Drawing Figures

52
AIR
54
50
FLUID
29
66
18
46
28
48
30
24
26
20
55
53
22
56
60
58
61
64
40
34
62
36
38
63
44
32
42

54
50
FLUID
AIR
52
29
18
46
48
28
30
68
AIR
72
AIR
74
70
FLUID
FLUID
22
56
58
60
64
40
34
62
36
38
44
32
42

BORE HOLE MINING

BACKGROUND OF THE INVENTION

The present invention relates to the mining of mineral deposits, in particular coal mining.

While various different types of mining procedures have been used over the years for the mining of coal, these procedures basically fall into two categories, underground mining and strip mining. In underground mining, there are several different types of procedures including room and pillar mining, long wall mining and hydraulic mining. In all of these procedures, however, tunnels in the earth are made through which the miners enter the earth to the location of the coal for carrying out the mining operation. In long wall and hydraulic mining operations the roof of the tunnel must be supported by leaving pillars in the seams. The pillars can reduce recovery by as much as 50%.

In strip mining, huge areas of the earth must be removed in order to extract coal from along the coal seam. The area of the earth over which the strip mine extends depends upon the depth to which the coal seam is to be mined. The deeper the mining of the seam the wider the area of the earth that must be disturbed.

Various attempts have also been made at conducting drilling operations between various tunnels underground; exemplary of such attempts are the embodiments illustrated in U.S. Pat. Nos. 3,167,354 and 4,123,109. In addition, some attempts have been made at subterranean hydraulic mining of mineral deposits such as shown in U.S. Pat. Nos. 3,874,733 and 4,092,045. Furthermore, with respect to the process of mixing the mineral deposits, such as coal, in a slurry for the purposes of transportation along a pipeline, such techniques are shown in U.S. Pat. Nos. 3,041,053 and 3,924,895.

With the increasing necessity for economically and efficiently obtaining sources of energy, it has become even more critical for finding new techniques for the mining of coal. Such problems are especially enhanced in light of the safety considerations in tunnel mining and the environmental concerns with strip mining.

SUMMARY OF THE INVENTION

An object of the present invention is to provide an improved procedure and associated equipment for the mining of coal in a more economic and efficient manner.

Another object of the present invention is to provide an improved procedure for the mining of coal that avoids the dangers involved with tunnel mining and the environmental problems of strip mining.

A further object of the present invention is to provide a procedure for the mining of minerals utilizing large shaft diameter drilling equipment arranged on the surface of the earth.

Still another object of the present invention is to provide drilling equipment for drilling along a coal seam from the surface of the earth for the mining of such coal.

Still a further object of the present invention is to provide a technique for mining coal utilizing reverse direction drilling equipment with a high torque drill bit attached at the end of a drill string.

A still further object of the present invention is to provide a drilling system capable of mining coal by a drilling operation from the surface of the earth by breaking up the coal and extracting the broken coal from the drilled hole by circulating fluid through portions of the drilling system in the drilled hole.

Minerals, in particular coal, that have been deposited in layers or along seams can be mined utilizing drilling procedures with the drilling rigs being located on the surface of the earth. The drilling system for such a mining operation in accordance with the present invention is composed of a large diameter drill rig capable of drilling at an angular orientation with respect to the vertical. As the drilling operation proceeds, the coal, or minerals, are broken into fragments. The broken coal fragments are removed from the drilled hole by a reverse dual string hydraulic method. The coal is then cleaned and the slurry concentration reduced for transportation in a slurry pipeline. Depending upon the terrain and the desired delivery point, the coal can be pumped or gravity fed to a loading terminal or user location. Once reaching such destination, the coal is then dried.

Several factors will determine the economic advantages of utilizing such a drilling operation. Such factors include the total recoverable reserves, the angle and depth of the coal seam, the continuity of the coal seam, the thickness of the seam, surrounding formations, terrain, climate, availability of water supplies and the penetration rate for the drilling. Minerals deposited in thick seams which are vertical or near vertical are primary candidates for mining by drilling operations. In particular, bituminous coal deposits that are presently mined by long wall, hydraulic or strip mining methods can be mined utilizing the drilling operations and equipment of the present invention.

After each hole is drilled, the hole can be refilled with proper roof supports. The roof supports are provided by placing cement plugs at regular intervals in the drilled holes and filling the space between the cement plugs with waste material from the mining excavation operations. By providing roof supports in this manner, adjacent drilled holes can be drilled closer together with additional reserves being produced.

The drilling operation in the present invention is a safer operation than tunnel mining inasmuch as no underground personnel are utilized. Furthermore, the drilling operation of the present invention does not create the environmental problems of strip mining. In utilizing the drilling operation for the mining of coal, large areas of the earth need not be excavated in order to remove the coal. Furthermore, the drilling operation can be utilized for extracting coal from a deeper depth in the earth than possible with a strip mining operation.

The method of the present invention utilizes drilling equipment that is arranged on the surface of the earth. In accordance with this operation, the drilling member is first drilled down into the earth for forming a large diameter hole and breaking up the mineral deposits as the drilling occurs. These broken mineral fragments are removed from the drilled hole as the drilling operation proceeds. During portions of the drilling operation, creep is induced in portions of the side walls of the drilled hole. After the drilling has continued for a certain distance into the hole, the drilling member is then retracted from the hole. As the drilling member is retracted, the mineral fragments which have fallen back into the hole above the drilling member due to the inducement of the creep effect in the side walls of the hole is drilled. These mineral fragments that are drilled as the drilling member is retracted are then removed from the hole.

The creep effect to which reference is made in this application is an effect that occurs when the pressure from the earth surrounding the hole provides a sufficient force for causing portions of the side walls of the hole to partially cave-in. Such a cave-in of the side walls places additional mineral deposits into the hole which can then be extracted by the drilling operation. As further explained below, such a creep effect can be induced by decreasing the fluid level in the hole so that the pressure of the earth surrounding the hole on the walls is greater than the static fluid pressure in the hole thereby causing the cave-in.

The removal of the mineral fragments from the hole is best accomplished by creating a fluid flow through the drilling member in the drilled hole. The flow of fluid carries the mineral fragments out of the hole. This fluid flow can be accomplished by utilizing dual wall string drilling equipment where water is fed into the hole through one chamber of the drill string and the water with the broken mineral fragments is then extracted from the hole through the other chamber of the drill string. The flow of fluid also travels across the cutting surface of the drilling bits so as to constantly wash away the broken mineral fragments so that such fragments are extracted from the hole. In addition, the washing of the cutting surface of the drilling member prevents the drilling member from becoming blocked or clogged by such mineral fragments.

Utilizing the drilling equipment of the present invention, it is possible to drill at an angular orientation with respect to the surface of the earth, with such angle being less than a right angle. By utilizing various stabilizers for stabilizing the drilling bit in order to prevent any substantial lateral movement, it is possible to conduct such drilling operation anywhere between 60° up to 90° with respect to the horizontal plane of the surface of the earth. Such stabilizing equipment includes a plurality of rollers and cylindrical members that are substantially the same size as the diameter of the hole being drilled. In order to allow the drilling bit to move into the earth, however, the stabilizer will be just slightly smaller, perhaps a few inches for a twenty foot diameter drill, than the diameter of the hole. For example, if the hole being drilled has a diameter of twenty feed then the stabilizer will be approximately 19 feet and 8 inches in diameter.

The present limits for angular drilling with the various embodiments disclosed herein are 30° from the vertical. Once the drilling assembly and drill string are more than 30° from the vertical, the wall drag becomes in excess of 30% of the drilling assembly weight. The problems encountered when the wall drag becomes excessive are hole deviation (failure to follow the seam of the mineral deposit) and reduced penetration rates. If improved drilling assembly can be fabricated, it may become possible to drill at an angle of 45° with respect to the vertical.

In addition to the hydraulic equipment providing a fluid flow for removing the drilled mineral fragments, the fluid provided by the mechanism also fills the drilled hole. The provision of such fluids serves as a static balancing force against the pressures on the side walls from the surrounding earth during the normal drilling operation except when a creep effect is to be induced. In addition, with the drilling of coal, the provision of fluid in the hole acts as a safety device during the drilling operation.

The drilling system of the present invention includes a primary drilling bit mechanism that is arranged at the forward end of the drilling string members that extend into the hole. A plurality of drilling bits, such as those of a gang drill, are arranged at the forward end of the drilling bit mechanism. In order to obtain a high torque device it is desirable if only the drilling bits themselves are rotated and not the entire drilling mechanism and drilling string members. For this purpose, an arrangement is provided for rotating the drilling bits down at the bottom of the hole being drilled instead of rotating such bits by rotating the entire drilling string from the surface of the earth. During the drilling operation, the drilling mechanism should be secured against lateral movement in order to enable the drilling to occur along a coal seam in the earth that extends at an angular orientation with respect to the surface of the earth.

For the purpose of rotating the drilling bits, several different types of well known down-hole driving arrangements can be utilized. Such arrangements include drilling fluid drive bits and down-hole electric drilling motors. In accordance with the embodiments illustrated in this application, the drilling bits are fluid driven by the hydraulic fluid circulated through the drilling equipment which is utilized for removing the broken mineral fragments.

In addition to the primary drilling bit mechanism, a secondary drilling bit mechanism can be arranged along the drilling string at a location above the primary drilling bit mechanism. This secondary drilling bit mechanism is arranged for enabling the mineral deposits to be drilled when retracting the drilling string from the drilled hole. For this purpose, raised bore drill bits facing in an upward direction can be utilized. These raised bore bits will drill out those mineral deposits that have fallen into the drilled hole due to the inducement of the creep effect in the walls of the drilled hole.

In order to enable fluid to be circulated through the drilling equipment, dual wall drilling string members are utilized. The dual wall drilling string members have an inner chamber and an outer chamber. The fluid is circulated through one of these chambers, generally the outer chamber, across the surface of the drilling bits and back through the other chamber. Since the inner chamber is generally larger, the fluid with the broken mineral fragments are generally extracted through the inner chamber of the dual wall drilling string members. To assist in the circulation of the fluid, air also can be pumped into the chambers. Such air can create either the necessary pressure for maintaining the fluid flow across the drilled bit surfaces or can be used for so as to supply air into the inner chamber for helping to extract the fluid with the mineral fragments from such chamber.

In utilizing the drilling mining operation of the present invention, the number of tons of coal per hour depends upon the diameter of the drill bit mechanism and the rate of drilling. Ideally, the diameter and drilling rate should be selected so as to produce at least 25 tons of coal per hour. In accordance with the preferred embodiment, the diameter of the drill should be selected in excess of 10 feet since such a drill can be operated at an extremely efficient and economical rate for producing coal well in excess of 25 tons per hour. For such purposes the typical rate of penetration would be at least 8 feet per hour.

To optimise the recovery of mineral deposits, adjacent bore holes should be drilled on a relatively close pattern. To accomplish this, bore holes are drilled in an alternating arrangement with the center line spacing of such holes on a 250% of hole diameter arrangement for the first set of holes. Once the first set of holes are drilled and subsequently plugged with cement plugs separated by waste material, the second set of holes are drilled on a center line spacing of 125% of hole diameter from the center of the holes of the first set of holes. By utilizing this method of hole spacing, a substantial percentage of in place reserves, e.g. 65%, can be recovered.

DESCRIPTION OF THE PREFERRED EMBODIMENTS

Figure 1:
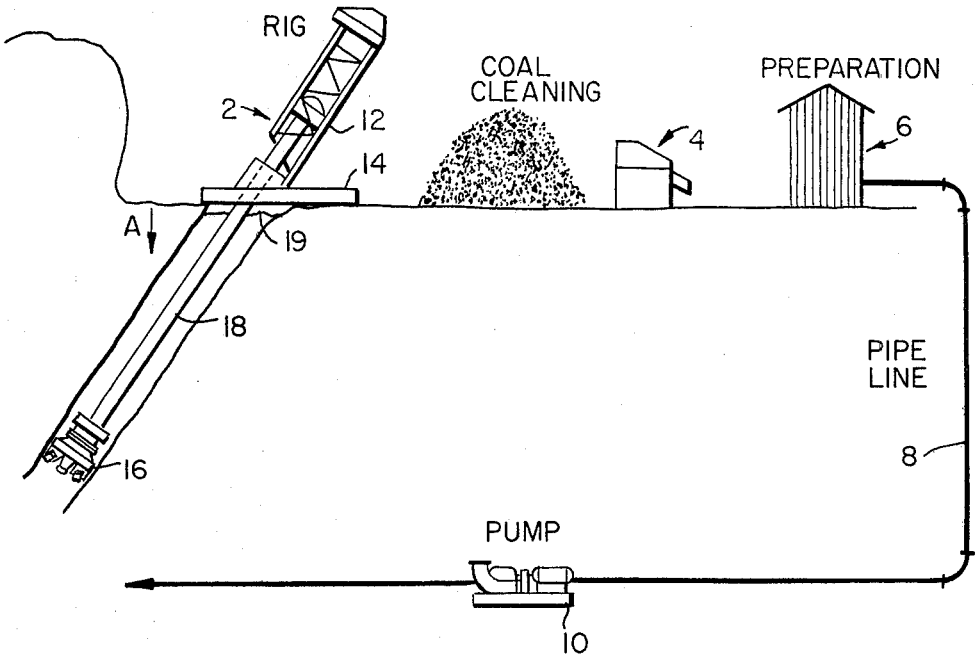
FIG. 1 is a schematic illustration of a coal mining operation in accordance with the present invention.

A schematic illustration of a coal mining operation in accordance with the present invention as illustrated in FIG. 1. As shown in that figure, a drilling system 2 is used for drilling into a coal seam in the earth. Inasmuch as most coal seams extend at an angle, the drilling assembly is shown drilling at an angle into the earth.

Drilling system 2 includes a drilling rig assembly 12 mounted on a platform 14. As the system is utilized, drilling bit assembly 16 drills into the earth for breaking up the coal formation into fragments that can be removed from the hole. The drilling bit assembly is mounted on the end of a drill string 18, which can be made up of a plurality of string members with additional members being added as the drilling bit assembly proceeds into the earth.

In accordance with the operation of the present invention, it is preferable for the drill string 18 not to rotate and for the rotational drive forces to be applied directly at the bit assembly 16. For this purpose any one of several different types of downhole drilling drivers can be utilized. During normal operation of the drilling procedure, the drilled hole is filled with fluid up to level 19; the purpose of such fluid will be explained further below.

After the coal is drilled out of the hole, it is cleaned, i.e. separated from the various rocks and earth that were removed with the coal at a cleaning station 4. The coal is then prepared in a slurry form at station 6 for transmission through a slurry pipeline 8. The coal slurry passing through pipeline 8 can either be forced through the pipeline due to gravity if the loading station is downhill or can be pumped by a pump 10. The coal eventually travels to a station where it is either loaded for further transportation or actually utilized. Various techniques for transporting coal in a slurry form are known in the art, such as shown for example, in U.S. Pat. No. 3,924,895.

As will be explained in greater detail below, during the drilling operation, the drill bit assembly 16 first drills into the hole in a forward direction. After the bit assembly has advanced by a predetermined distance, a creep effect is induced in a portion of the side walls of the drilled hole. The creep effect to which reference is made herein is a partial cave-in effect that occurs when the pressure on the walls of the drilled hole exceeds the static pressure within the hole.

As previously indicated, the hole is filled with fluid to a level 19 during normal drilling operation. The fluid within the hole provides a static balancing pressure that prevents any caving-in of the side walls of the hole. The pressure for such cave-in effect is created by that portion of the earth above the drilled hole that applies a force due to the weight of the earth such as represented by arrow A in FIG. 1. If the fluid level in the drilled hole is allowed to drop to a sufficiently low level then the force of the earth above a portion of the wall of the drilled hole will cause such wall portion to partially cave-in. This expands the hole and places additional coal into the hole which then can be drilled out.

After such a partial cave-in, or creep, has been accomplished, a reversed drilling operation can be carried out. For this purpose, drill bit assembly 16 can be provided with drill bits facing in an upwards direction along the drilling path. Exemplary of the type of drill bits that can be utilized for this purpose are raised bore bits. The drill string with the drilling bit assembly is then retracted from the drilled hole with the upwardly facing drilling bits drilling out the coal that has caved into the hole. Thus, coal can be mined from the hole both when advancing the drilling bit assembly in a forward direction and when retracting such assembly from the hole. During both operations, the drilled coal fragments are hydraulically removed from the drilled hole.

Figure 2:
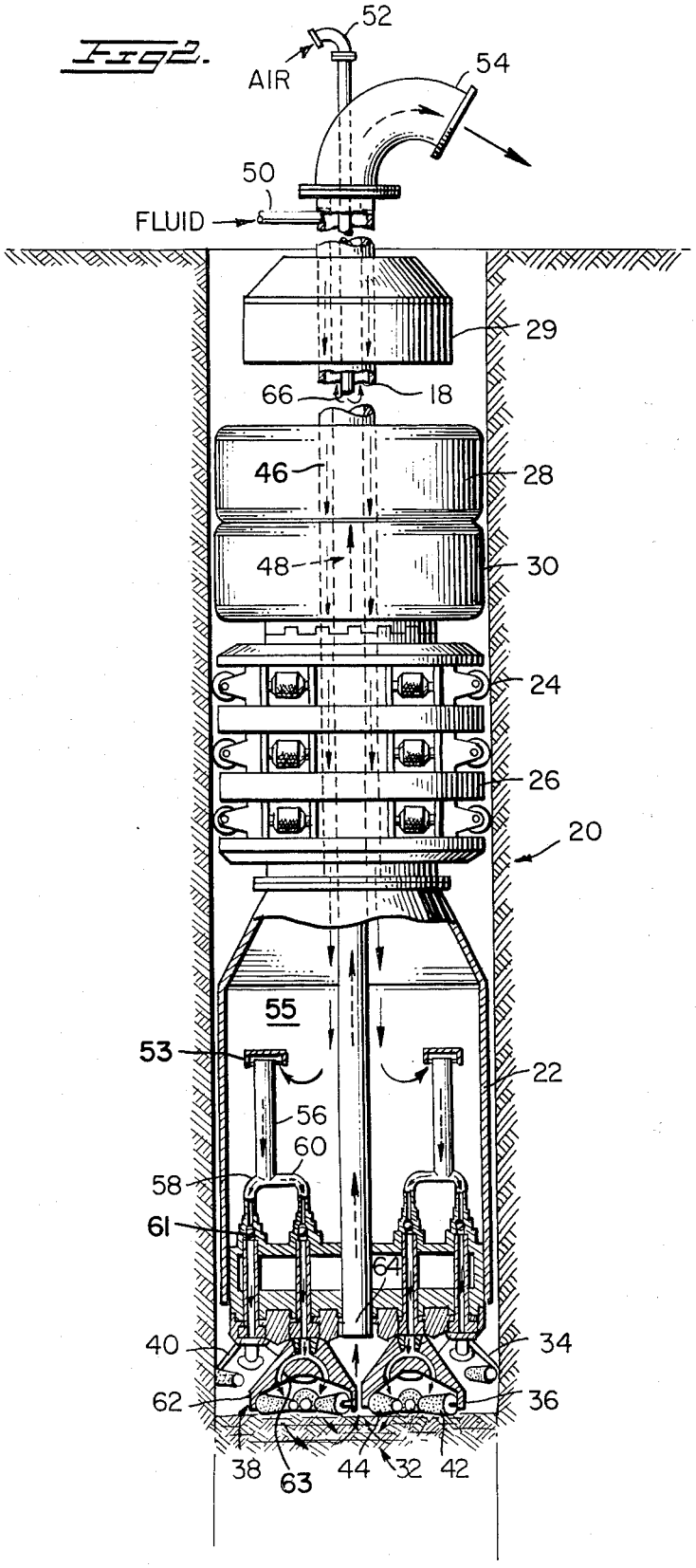
FIG. 2 is a side elevational view partially cut away of a drilling mechanism constructed in accordance with the present invention.

In FIG. 2, one embodiment of a portion of the drilling system of the present invention is illustrated. As shown, a drilling mechanism 20 is mounted on drill string member 18 which extends below the ground level. Drilling mechanism 20 includes on its lower end a drilling bit mechanism 22 which has a plurality of individual drilling bits. In order to secure the drilling mechanism against lateral movement during the drilling operation, a plurality of stabilizer members can be arranged around the drill string. Such stabilizing members can include a plurality of rollers 24 and stabilizer rings 26. While only one set of stabilizer members have been illustrated, a plurality of such members can be provided.

A plurality of circular weights 28 and 30 also are arranged along the drill string in the area adjacent to the drilling bit mechanism. Such weights help to press the drilling bit mechanism with the drilling bits against the bottom of the hole being drilled. Here again a plurality of such weights can be provided depending upon the hardness of the particular coal seam being drilled. Mounted above the weights can be additional rollers and circular stabilizing members. At the top of drilling mechanism 20 is a cap 29. In the space between cap 29 and weight 28 surrounding drilling string 18 can either be additional weights and/or additional stabilizer members.

The particular type of drill bit arrangement utilized on drill bit mechanism 22 is a set of gang drill bits 32. The gang drill bit assembly has a plurality of assemblies 34, 36, 38 and 40. Each of these subassemblies of bits is individually rotated by a fluid flow across each assembly. In addition each of the subassemblies has a plurality of rotating individual drill bits such as bits 42 and 44.

In order to drive the drill bits, fluid is fed along the drill string members to the area of the subassemblies. This fluid also serves to remove the drilled coal fragments during the drilling operation. Furthermore, the fluid also fills the drilled hole for providing the static balancing force for preventing the walls of the hole from caving in except when it is desired to induce a creep effect.

For the purpose of enabling fluid to be fed into the drilled hole and then extracted therefrom, dual wall string members are utilized. The string members that form drill string 18 have an outer chamber 46 and an inner chamber 48. Fluid is fed into outer chamber 46 through fluid inlet 50 which is arranged above the ground. The fluid then travels down along the outer chamber of the dual wall string members until it reaches fluid chamber 55, as shown in FIG. 2. Fluid from chamber 55 then travels under weir 53 into a fluid drive line 56. The fluid flows along drive line 56 and is diverted into two separate lines 58 and 60. The flow of fluid is maintained in only one direction by a ball check valve 61 in order that the fluid along with any coal fragments cannot flow back into chamber 55 from the area of the drilling operation. The flow of fluid through the line then travels down to the area of the subassemblies. By creating a propelling force along guide impeller 63 and rotating bracket 62, the subassembly is rotated. The fluid also flows over the individual drill bits, such as bits 42 and 44, for rotating these bits. In addition, as the whole subassembly is rotated, the drill bits rotate as they roll along the coal being drilled.

As the drilling operation proceeds, the fluid with the coal fragments are drawn back into the drill string members through a return line 64. Return line 64 leads back into inner chamber 48 of drill string 18. To assist in the withdrawl of the fluid with the coal fragments from chamber 48, an air pressure force is created by air emitted through outlet 66 of an air line 52. The slurry with the coal fragments is then emitted from the drilling system through an outlet 54.

Figure 3:
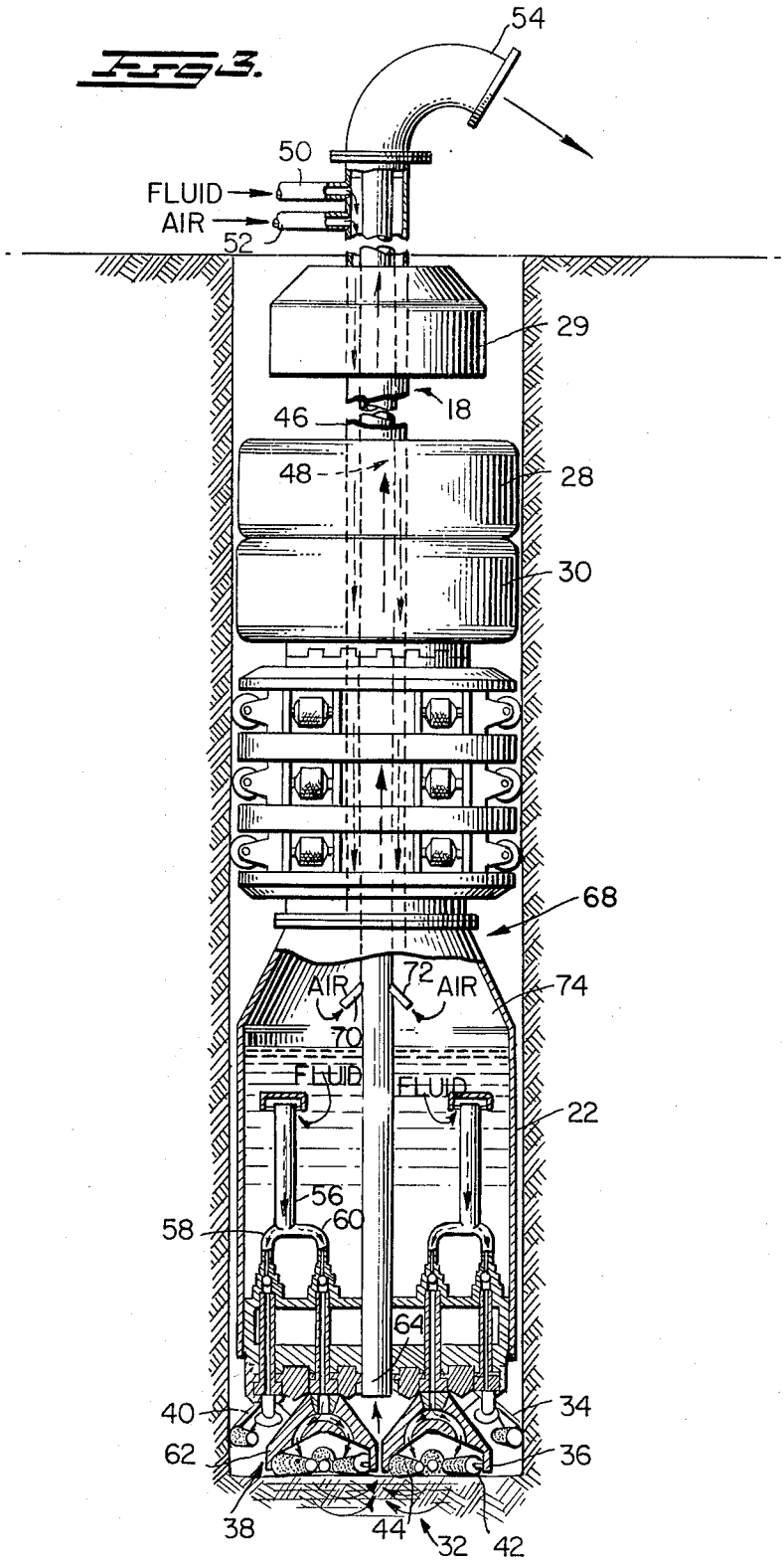
FIG. 3 is a side elevational view partially cut away of a modified embodiment of a drilling mechanism in accordance with the present invention.

A modified embodiment of the drilling mechanism is illustrated in FIG. 3. In this figure those elements that are the same as those in FIG. 2 are identified by the same reference numerals the primary distinctions between the drilling mechanism 68 illustrated in FIG. 3 and the drilling mechanism 20 illustrated in FIG. 2 reside in the air flow system that is employed. In drilling mechanism 68, air is fed in through inlet 52 directly into outer chamber 46 of the drill string member. The air then travels along with the fluid down into chamber 74. Chamber 74 is thus pressurized for helping to force the fluid through drive line 56 for rotating the drilling bit subassemblies. Air along with the coal slurry can be sucked back into line 64 for extracting the coal fragments. For enabling the air to be drawn into the extraction line and inner chamber 48 of the drill string member, air inlet ducts 70 and 72 are provided at the top of chamber 74. The operation of this modified embodiment of the drilling mechanism is similar to drilling mechanism 20 as previously described above.

Figure 4:
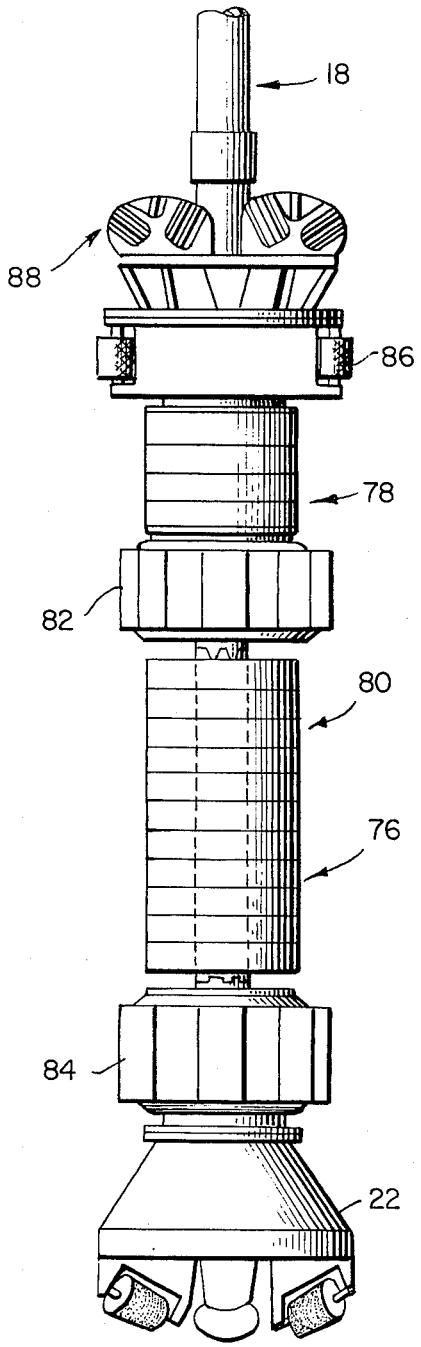
FIG. 4 is a side elevational view of a modified embodiment of a drilling mechanism in accordance with the present invention.

Another modified embodiment of a drilling mechanism is shown in FIG. 4. Drilling mechanism 76 has a drilling bit mechanism 22 similar to the gang drill mechanism previously described above. Arranged above the drilling bit mechanism are weights 78 and 80 and stabilizing members 82, 84 and 86. While only one rotating stabilizer mechanism 86 is illustrated, a plurality of such members could be utilized. At the top of the drilling mechanism 76 are raised bore bits 88. Such raised bore bits are used for drilling the coal that falls back into the hole due to the inducement of creep during the drilling operation. Thus, as drilling mechanism 76 is retracted from the hole, raised bore bit 88 drill out the coal in the hole. Raised bore bits 88 also can be utilized on those drilling mechanisms illustrated in FIGS. 2 and 3. Thus, with the inclusion of such raised bore bits, the drilling of coal can be accomplished in both directions, i.e. as the drilling bit mechanism 22 advances into the earth and as it is retracted from the earth. During both operations, the broken coal fragments can be removed from the hole by circulating fluid through the hole and through the drill string members such as previously described above.

Figure 5:
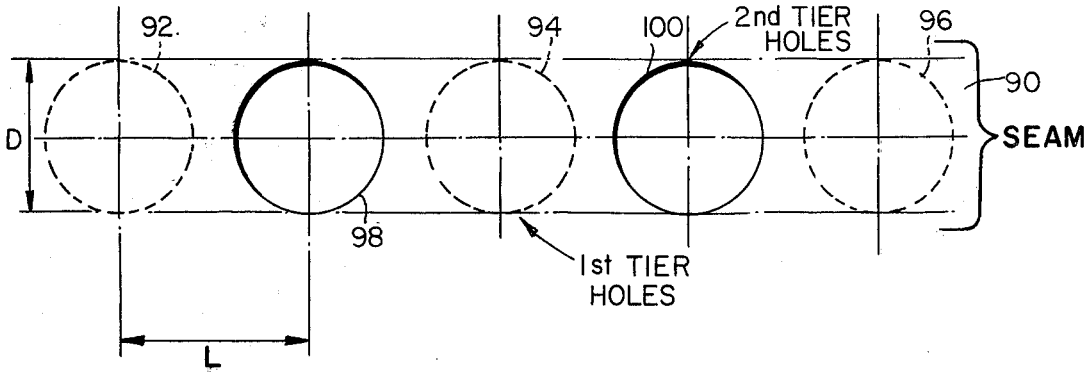
FIG. 5 is a schematic illustration of a drilling pattern along a seam of a coal deposit in accordance with the drilling operation of the present invention.

During the drilling operation, it is desirable to drill a plurality of holes as close together as possible. On the other hand, sufficient solid ground must be provided for enabling the drilling rig to be mounted on the earth above the hole. In order to satisfy both requirements, a drilling pattern such as illustrated in FIG. 5 can be utilized. As shown, the holes are drilled along a coal seam 90. First, a first set of holes, 92, 94 and 96 are drilled. The first set of holes are then plugged by cement plugs separated by waste material that has been excavated from the hole and separated out from the coal. After the first holes have been replugged, a second set of holes, 98 and 100 are drilled. After drilling the second set of holes, these holes also can be plugged in the same manner as the holes of the first set. The spacing between the holes of the first set is 250% of the diameter D of the hole. The second set of holes are then spaced so that their center point is separated from the center point of the adjacent first holes by a distance L that is equal to 125% of the diameter D of the holes. In this manner, approximately 65% of the coal can be recovered from the coal seam.

Accordingly, in utilizing the drilling equipment described above, the drilling bit is first drilled into the earth in a direction extending along a coal seam with the drilling bit breaking up the coal. The broken coal fragments are then extracted from the hole utilizing the flow of fluid through the drill string members and across the face of the bits of the drilling bit mechanism. After the drilling bit mechanism has advanced a certain distance into the earth, the fluid level in the hole is dropped and creep is induced in portions of the walls of the drilled hole. Such wall portions then partially cave in thereby filling part of the hole with additional coal which can be drilled out. Care must be taken not to cause too much coal to cave into the hole thereby making it impossible to drill in an outward direction. The drilling bit is then retracted from the hole at which time further drilling in the hole is carried out. The coal broken during the reverse drilling operation is removed from the hole with the flow of fluid through the hole. The holes are plugged after being drilled with spaced concrete plugs and waste material from the drilling operation after the drilling bit has been retracted. A new hole is then drilled in a direction extending along the coal seam.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. A method of mining mineral deposits utilizing large shaft diameter drilling equipment arranged on the surface of the earth, the method comprising the steps of:

(a) drilling down into the earth with a drilling member for forming a large diameter hole so as to break up mineral deposits as the drilling occurs and during such drilling operation maintaining a working fluid in the drilled hole;

(b) removing broken mineral fragments from the drilled hole;

(c) decreasing the level of fluid in the drilled hole so as to decrease the hydrostatic pressure created by the fluid against the side walls of the hole for intentionally inducing creep in portions of the side walls of the drilled hole during the drilling operation for causing substantial portions of such side walls to fall into the drilled hole;

(d) retracting the drilling member from the drilled hole and simultaneously drilling out any mineral fragments from the side walls that have fallen into the hole above the drilling member; and, (e) removing such mineral fragments as the drilling member is retracted from the drilled hole.

2. A method according to claim 1 wherein said step of removing mineral fragments is accomplished by creating fluid flow through the drilling member in the drilled hole for carrying out the mineral fragments.

3. A method according to claim 2 wherein said step of removing mineral fragments includes filling the drilled hole with fluid and circulating fluid through the drilling member of the drilling equipment and across the cutting surface of the drilling member of the drilling equipment and the flow of fluid carries the mineral fragments for removing such fragments from the drilled hole.

4. A method according to claim 3 wherein when intentionally inducing creep in portions of the inner wall of the drilled hole by reducing the level of fluid in the hole, the pressure on portions of the wall of the drilled hole from the surrounding earth outside of the drilled hole becomes greater than the static fluid pressure of the fluid in the hole so that such wall portions will partially cave in.

5. A method according to claim 1, 2, 3 or 4 further comprising the step of stabilizing the drill bit and drilling member of the drilling equipment in the drilled hole against any substantial lateral movement during the drilling operation.

6. A method according to claim 5 wherein the drilling operation is carried out at an angular orientation to the horizontal surface of the earth, with such angle being less than a right angle.

7. A method according to claim 1, 2, 3 or 4 wherein during a substantial portion of the drilling operation, the drilled hole is filled with fluid to help insure the safety of the drilling operation.

8. A method according to claim 7 wherein the drilling operation is carried out at an angular orientation to the horizontal surface of the earth, with such angle being less than a right angle.

9. A drilling method of mining coal utilizing reverse direction drilling equipment with a high torque drill bit attached at the end of a drill string and a water circulating mechanism, the method comprising the steps of:

(a) drilling into the earth from the surface of the earth with the drill bit for breaking up the coal;

(b) maintaining water in the drilled hole during the normal drilling operation;

(c) circulating water through the drill string across the surface of the drill bit and extracting water from the hole for removing broken coal from the drilled hole;

(d) during portions of the drilling operation intentionally inducing creep in portions of the walls of the drilled hole by reducing the hydrostatic pressure created by water in the drilled hole against the side walls of the hole for causing such portions to partially cave in;

(e) retracting the drill bit from the drilled hole so that as the drill bit is retracted further drilling of the coal from the portions of the walls that have caved in occurs; and, (f) removing broken coal as the drill bit is retracted from the drilled hole.

10. A method according to claim 9 wherein the drilling operation is carried out an angular orientation to the horizontal surface of the earth with such angle being less than a right angle.

11. A method according to claim 9 wherein said drilling operation drills a hole with a diameter of at least 10 feet and at a rate sufficient to produce 25 tons of coal per hour.

12. A method according to claim 9 wherein said step of removing mineral fragments includes filling the drilled hole with fluid and circulating fluid so that the fluid flows through the drill string of the drilling equipment and across the surface of the drill bit of the drilling equipment and the flow of fluid carries the mineral fragments for removing such fragments from the drilled hole.

13. A method according to claim 12 wherein creep is created in portions of the inner wall of the drilled hole by reducing the level of fluid in the hole so that pressure on portions of the wall of the drilled hole from the surrounding earth outside of the drilled hole is greater than the static fluid pressure of the fluid in the hole so that such wall portions will partially cave in.

14. A method according to claim 9, 10, 11, 12 or 13 further comprising the step of stabilizing the drill bit and drill string of the drilling equipment in the drilled hole against any substantial lateral movement during the drilling operation.

15. A drilling system for mining coal by drilling into the earth from the surface of the earth, breaking up the coal and extracting the broken coal from the drilled hole by circulating fluid through the portions of the drilling system in the drilled hole, the drilling system comprising:

primary drilling bit means arranged at the forward end of the system for drilling into the earth and having a plurality of drilling bits;

drilling string member for attaching said drilling bit means to portions of said drilling system arranged on the surface of the earth;

means for rotating said drilling bits without rotating said drilling string member;

stabilizing means coupled to said drilling string member near said drilling bit means for securing said drilling bit means against lateral movement for enabling said drilling bits to drill along a coal seam in the earth that extends at an angular orientation with respect to the surface of the earth; and, secondary drilling bit means arranged near but above and concentric with said primary drilling bit means for enabling coal that has fallen into the drilled hole to be drilled when retracting said drilling string member and said primary drilling bit means from a drilled hole.

16. A drilling system according to claim 15 further comprising fluid circulating means for circulating fluid across said drilling bits and through said drilling string member for removing broken coal from a drilled hole.

17. A drilling system according to claim 16 wherein said drilling string member has an inner chamber and an outer chamber and said fluid circulating means circulates fluid through one of said chambers, across the surface of said drilling bits and back through the other of said chambers.

18. A drilling system according to claim 17 wherein said fluid circulating means includes means for pumping air into one of said chambers carrying fluid for helping to circulate such fluid.

19. A drilling system according to claim 16 wherein said fluid circulating means also fills the hole being drilled with fluid.

20. A drilling system according to claim 19 further comprising means for inducing creep in portions of the walls of the hole being drilled.

21. A drilling system according to claim 20 wherein said means for inducing creep includes means for lowering the level of fluid in the drilled hole so that pressure on the walls of the drilled hole from the surrounding earth is greater than the static fluid pressure in the drilled hole so that parts of the walls cave in.

22. A drilling system according to claim 18 wherein said fluid circulating means also fills the hole being drilled with fluid.

23. A drilling system according to claim 22 further comprising means for inducing creep in portions of the walls of the hole being drilled.

24. A drilling system according to claim 23 wherein said means for inducing creep includes means for lowering the level of fluid in the drilled hole so that pressure on the walls of the drilled hole from the surrounding earth is greater than the static fluid pressure in the drilled hole so that parts of the walls cave in.

25. A drilling system according to claim 16 wherein said means for rotating said drilling bits is a high torque downhole drilling motor.

26. A drilling system according to claim 25 wherein said downhole drilling motor is hydraulically driven.

27. A drilling system according to claim 15 wherein said secondary drilling bits means includes raised bore bits facing in an upward direction towards the surface of the earth.

28. A method of mining coal utilizing reverse direction drilling equipment with a drilling bit attached at the end of a drill string and a water circulating mechanism, the method comprising the steps of:

(a) drilling in a foward direction in the earth from the surface of the earth in a direction extending along a coal seam with the drilling bit for breaking up the coal;

(b) extracting broken coal from the drilled hole during the drilling operation;

(c) intentionally inducing creep in portions of the walls of the drilled hole during portions of the drilling operation for causing substantial portions of the walls to partially cave in;

(d) retracting the drilling bit from the drilled hole;

(e) further drilling in the hole in an area approximately concentric with the drilled hole formed during said forward drilling operation as the drilling bit is retracted for drilling out those portions of the walls that have caved into the drilled hole;

(f) removing broken coal as the drilling bit is retracted from the drilled hole;

(g) plugging the drilled hole with spaced concrete plugs and waste material from the drilling operation after the drilling bit has been retracted; and, (h) commencing drilling of a new hole in a direction extending along a coal seam.

29. A method of mining mineral deposits utilizing a drilling system including: a primary drilling bit mechanism arranged at the forward end of the system for drilling into the earth and having a plurality of drilling bits; a drilling string member for attaching the drilling bit mechanism to portions of the drilling system arranged on the surface of the earth; a drive mechanism for rotating drilling bits without rotating the drilling string member; a secondary drilling bit mechanism arranged concentric with and near the primary drilling bit mechanism for enabling minerals to be drilled when retracting the drilling string member and the primary drilling bit mechanism from a drilled hole; and, a stabilizing mechanism coupled to the drilling string member near the drilling bit mechanism for securing the drilling bit mechanism against lateral movement for enabling the drilling bits to drill along a coal seam in the earth that extends at an angular orientation with respect to the surface of the earth; the method comprising the steps of:

(a) drilling down into the earth with the primary drilling bit mechanism for forming a large diameter hole so as to break up mineral deposits as the drilling occurs;

(b) stabilizing the primary drilling bit mechanism against lateral movement during the drilling operation;

(c) removing broken mineral fragments from the drilled hole;

(d) intentionally inducing creep in portions of the side walls of the drilled out hole during the drilling operation for causing substantial portions of the side walls to fall into the drilled hole;

(e) retracting the primary drilling bit mechanism and the drilling string member from the drilled hole and with the secondary drilling bit mechanism drilling in an area concentric with the drilled hole formed by the primary drilling bit mechanism so as to drill out any mineral fragments that have fallen into the hole above the secondary drilling bit mechanism; and, (f) removing such mineral fragments as the drilling member is retracted from the drilled hole.

30. A method according to claim 29 wherein the drilling system further includes a fluid circulating mechanism and said step of removing mineral fragments is accomplished by the fluid circulating mechanism creating fluid flow through the drilling member in the drilled hole for carrying out the mineral fragments.

31. A method according to claim 30 wherein said step of removing mineral fragments includes filling the drilled hole with fluid and circulating fluid through the drilling string member of the drilling system and across the cutting surface of the drilling bit mechanism of the drilling system and the flow of fluid carries the mineral fragments for removing such fragments from the drilled hole.

32. A method according to claim 31 wherein creep is created in portions of the inner wall of the drilled hole by reducing the level of fluid in the hole so that pressure on portions of the wall of the drilled hole from the surrounding earth outside of the drilled hole is greater than the static fluid pressure of the fluid in the hole so that such wall portions will partially cave in.

33. A method according to claim 29, 30, 31 or 32 wherein the drilling operation is carried out at an angular orientation to the horizontal surface of the earth, with such angle being less than a right angle.

34. A method according to claim 29, 30, 31 or 32 wherein during a substantial portion of the drilling operation, the drilled hole is filled with fluid to help insure the safety of the drilling operation.

35. A method according to claim 34 wherein the drilling operation is carried out at an angular orientation to the horizontal surface of the earth, with such angle being less than a right angle.

36. A method according to claim 29 wherein said drilling operation drills a hole with a diameter in excess of 10 feet and at a rate sufficient to product 25 tons of coal per hour.

37. A method according to claim 29 where the drive mechanism for rotating said drilling bits is a high torque downhole drilling motor and further comprising the step of hydraulically driving the downhole drilling motor.

38. A method of mining coal utilizing reverse direction drilling equipment with a drilling bit attached at the end of a drill string and a water circulating mechanism, the method comprising the steps of:

(a) drilling into the earth from the surface of the earth in a direction extending along a coal seam with the drilling bit for breaking up the coal;

(b) extracting broken coal from the drilled hole during the drilling operation;

(c) inducing creep in portions of the walls of the drilled hole during portions of the drilling operation for causing such portions of the wall to partially cave in;

(d) retracting the drilling bit from the drilled hole;

(e) further drilling in the hole as the drilling bit is retracted;

(f) removing broken coal as the drilling bit is retracted from the drilled hole;

(g) plugging the drilled hole with spaced concrete plugs and waste material from the drilling operation after the drilling bit has been retracted;

(h) commencing drilling of a new hole in a direction extending along a coal seam;

(i) drilling a first set of holes and plugging such holes in such manner; and, (j) drilling and plugging a second set of holes in such manner so that the holes of the second set are interspersed with the holes of the first set of drilled holes and such holes are drilled so that the distance between the center points of adjacent holes is approximately 125% of the diameter of each drilled hole.

39. A method of mining mineral deposits utilizing a drilling system including:

a primary drilling bit mechanism arranged at the forward end of the system for drilling into the earth and having a plurality of drilling bits; a drilling string member for attaching the drilling bit mechanism to portions of the drilling system arranged on the surface of the earth; a drive mechanism for rotating drilling bits without rotating the drilling string member; a secondary drilling bit mechanism arranged near but above the primary drilling bit mechanism for enabling coal to be drilled when retracting the drilling string member and the primary drilling bit mechanism from a drilled hole; and, a stabilizing mechanism coupled to the drilling string member near the drilling bit mechanism for securing the drilling bit mechanism against lateral movement for enabling the drilling bits to drill along a coal seam in the earth that extends at an angular orientation with respect to the surface of the earth; the method comprising the steps of:

(a) drilling down into the earth with the primary drilling bit mechanism for forming a large diameter hole so as to break up mineral deposits as the drilling occurs;

(b) stabilizing the primary drilling bit mechanism against lateral movement during the drilling operation;

(c) removing broken mineral fragments from the drilled hole;

(d) inducing creep in portions of the side walls of the drilled out hole during the drilling operation;

(e) retracting the primary drilling bit mechanism and the drilling string member from the drilled hole and with the secondary drilling bit mechanism drilling out any mineral fragments in the hole above the secondary drilling but mechanism;

(f) removing such mineral fragments as the drilling member is retracted from the drilled hole;

(g) drilling a first set of holes and plugging with concrete plugs and waste the drilled holes in such manner; and, (h) drilling a second set of holes with the holes of such second set being interspersed with the holes of the first set of drilled holes with the holes being drilled so that the distance between the center lines of adjacent holes is approximately 125% of the diameter of each drilled hole.

* * * * *

UNITED STATES PATENT AND TRADEMARK OFFICE

CERTIFICATE OF CORRECTION

PATENT NO. : 4,330,155

DATED : May 18, 1982

INVENTOR(S) : Paul Richardson and David A. Whitley

It is certified that error appears in the above—identified patent and that said Letters Patent is hereby corrected as shown below:

Column 3, line 45, "feed" should be --feet--.

Column 10, line 22, after "out" insert --at--.

Column 14, line 44, change "but" to --bit--.

Signed and Sealed this

*Eighth* Day of *February 1983*

[SEAL]

*Attest:*

GERALD J. MOSSINGHOFF

*Attesting Officer*

*Commissioner of Patents and Trademarks*